United States Patent [19]

Schrag et al.

[11] 4,081,067

[45] Mar. 28, 1978

[54] INTERNAL VIBRATION DAMPENING MEANS FOR PRINTING MECHANISM

[75] Inventors: Robert L. Schrag; Harold A. Long; Robert T. Harvey, all of Wichita, Kans.

[73] Assignee: NCR Corporation, Dayton, Ohio

[21] Appl. No.: 775,234

[22] Filed: Mar. 7, 1977

[51] Int. Cl.[2] ..... B41J 3/04

[52] U.S. Cl. ..... 197/1 R; 101/93.05

[58] Field of Search ..... 197/1 R; 101/93.05

[56] References Cited

U.S. PATENT DOCUMENTS

| | | | |
|---|---|---|---|
| 3,897,865 | 8/1975 | Darwin et al. | 197/1 R |
| 3,900,094 | 8/1975 | Larsen et al. | 197/1 R |
| 3,929,214 | 12/1975 | Hebert | 197/1 R |
| 3,991,871 | 11/1976 | McIntosh | 197/1 R |
| 4,004,671 | 1/1977 | Kondur | 197/1 R |

FOREIGN PATENT DOCUMENTS

| | | | |
|---|---|---|---|
| 2,449,235 | 10/1974 | Germany | 197/1 R |

*Primary Examiner*—Ralph T. Rader
*Attorney, Agent, or Firm*—J. T. Cavender; Albert L. Sessler, Jr.

[57] ABSTRACT

In a matrix print head, a plurality of elongated printing elements, mounted in a frame, are driven axially by electromagnetic means to effect printing on record media positioned adjacent to the printing ends of the printing elements. A dampening element, of generally conical configuration, is centrally disposed in the frame, within the volume defined by the plurality of printing elements, in order to dampen the bending and vibration of the printing elements, and thus reduce or eliminate consequent fatigue failure.

13 Claims, 8 Drawing Figures

INTERNAL VIBRATION DAMPENING MEANS FOR PRINTING MECHANISM

BACKGROUND OF THE INVENTION

In the field of high-speed printing devices which are especially suitable for use in connection with electronic data processing systems, the wire matrix type of printer has come into increasing use. In this type of printer, letters, numbers and symbols are formed from a series of dots produced by the impact of the ends of a plurality of wire elements on record media, most customarily in combination with an ink ribbon which provides the ink needed to produce a mark on the record medium being printed upon.

One problem which has arisen in connection with use of printers of the wire matrix type is that of fatigue breakage of the print wires and associated springs employed to return the wire to a non-printing position after a printing stroke. This breakage results from bending and vibration of the print wires caused by the high force employed to drive the wires over a short distance to impact upon the record medium being printed upon or the ink ribbon associated therewith. In order to reduce or eliminate such breakage, in some prior art structures, the individual print wires have been confined within print head blocks or units, or within tubes or coil springs anchored in the printer framework. However such structures have the disadvantages of increasing the parts and labor costs, and also tend to impede the movement of the printer wires by frictional engagement between the wires and the tubes. This, in turn, has led in some instances to further structural alterations of the printers to provide means for lubricating the wires within the tubes, thereby additionally increasing the cost and complexity of the assembly.

In another approach to solution of this problem, tubular elements have been placed on the print wires to ride freely thereon and exercise a vibration dampening function, as disclosed and claimed in the co-pending United States patent application Ser. No. 758,521, filed Jan. 11, 1977, inventors Nelson et al., now U.S. Pat. No. 4,060,161, issued Nov. 29, 1977, assigned to the assignee of the present application.

SUMMARY OF THE INVENTION

This invention relates to a printer of the matrix type, and more particularly relates to such a printer which includes means for dampening vibration and bending of the print elements to reduce or eliminate fatigue failure.

In accordance with one embodiment of the invention, a printing mechanism comprises frame means including at least one transverse support member located intermediate of the ends of the frame means; a plurality of elongated printing elements extending through and supported by said support member in an array of generally conical configuration and capable of being driven in an axial direction to effect printing; driving means operatively connected to said printing elements for axially driving said printing elements; and dampening means of generally conical configuration disposed completely within said array of elongated printing elements, secured to said support member and having a surface from which each of the elongated printing elements is physically separated when at rest and when in normal axial movement, said dampening means being positioned to limit undesired transverse movement and vibration of said elongated printing elements during and following operation thereof by said driving means.

One advantage of the present invention is that dampening of the bending and vibration of the print elements is achieved without frictional drag on the print elements since the print elements are not normally in contact with the dampening means and are free to move axially in normal printing movement without engaging the dampening means.

Another advantage of the present invention is that dampening means for the print elements are provided which are inexpensive both in terms of the cost of the parts and in terms of the cost of assembly.

It is accordingly an object of the present invention to provide a print head including elongated printing elements having an internal fixed vibration dampening means for the printing elements which is both inexpensive and effective in operation.

Another object is to provide a print head having elongated printing elements and also having vibration dampening means which does not impose a frictional load on the print elements during their normal operation.

A further object is to provide a print head which is durable and reliable in operation.

With these and other objects, which will become apparent from the following description, in view, the invention includes certain novel features of construction and combinations of parts, one form or embodiment of which is hereinafter described with reference to the drawings which accompany and form a part of this specification.

DESCRIPTION OF THE PREFERRED EMBODIMENT

Figure 1:
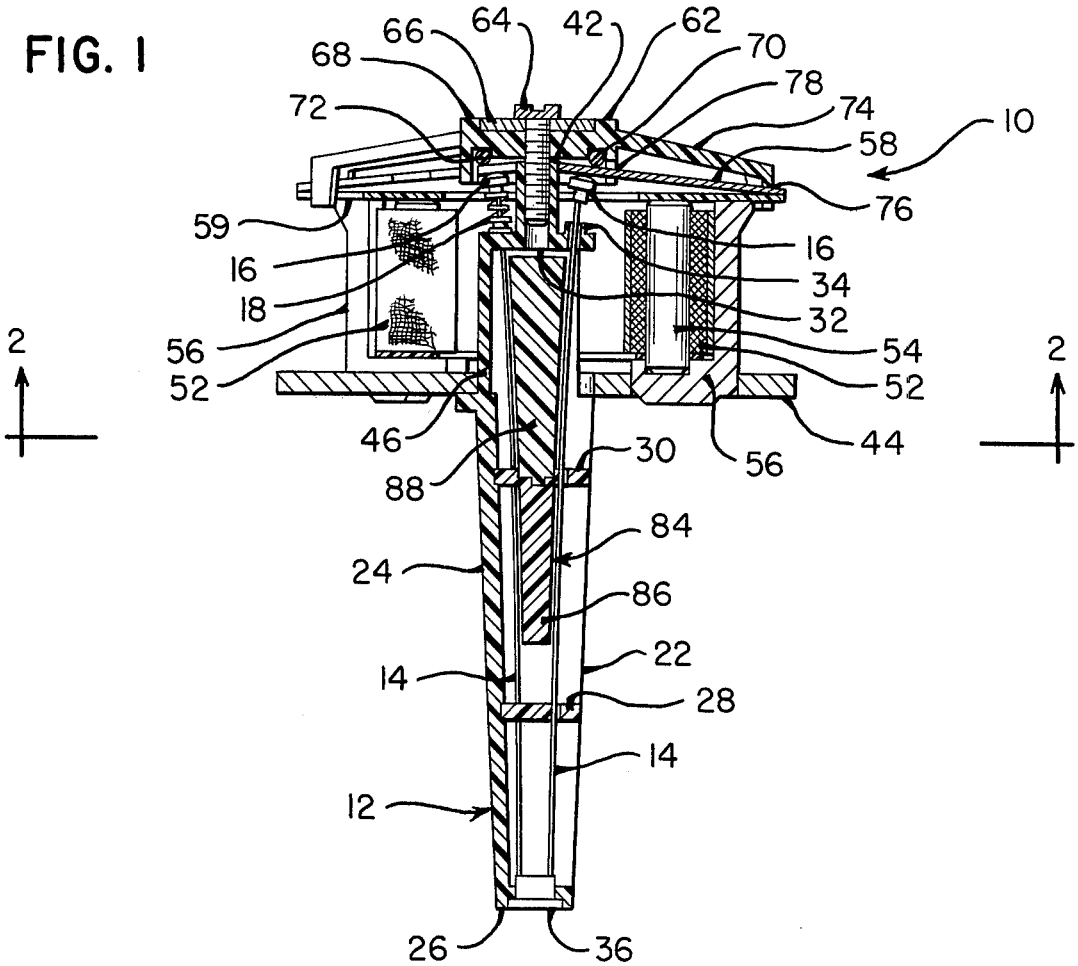
FIG. 1 is a sectional view, taken along line 1—1 of FIG. 2, of one embodiment of a print head in accordance with the present invention.
Figure 2:
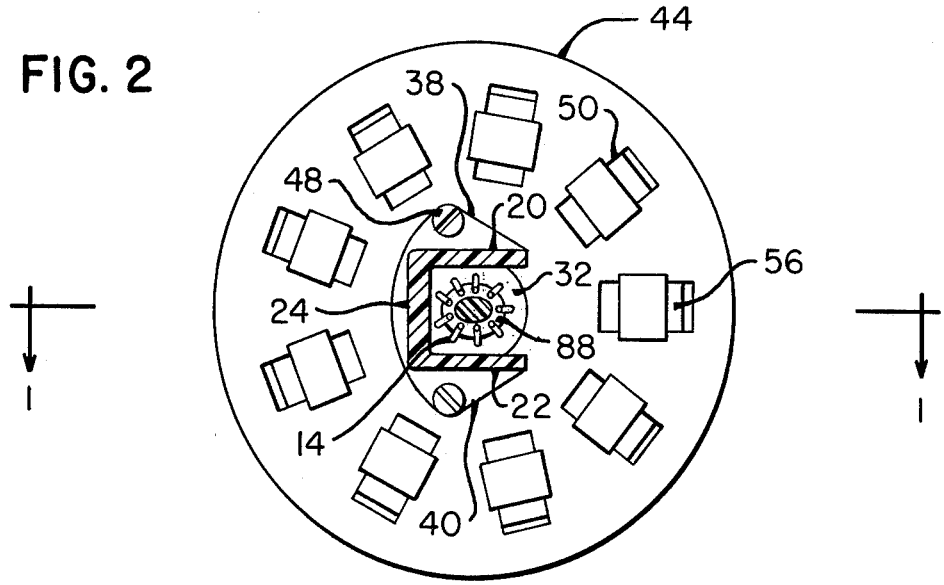
FIG. 2 is a cross-sectional view, taken along line 2—2 of FIG. 1.

Referring now particularly to FIGS. 1 and 2 of the drawings, a print head 10 of the wire matrix type is shown. This print head is similar in general configuration to the print head disclosed in U.S. Pat. No. 3,929,214, issued Dec. 30, 1975, to which reference may be had for a more detailed description of certain aspects of the print head structure.

Figure 3:
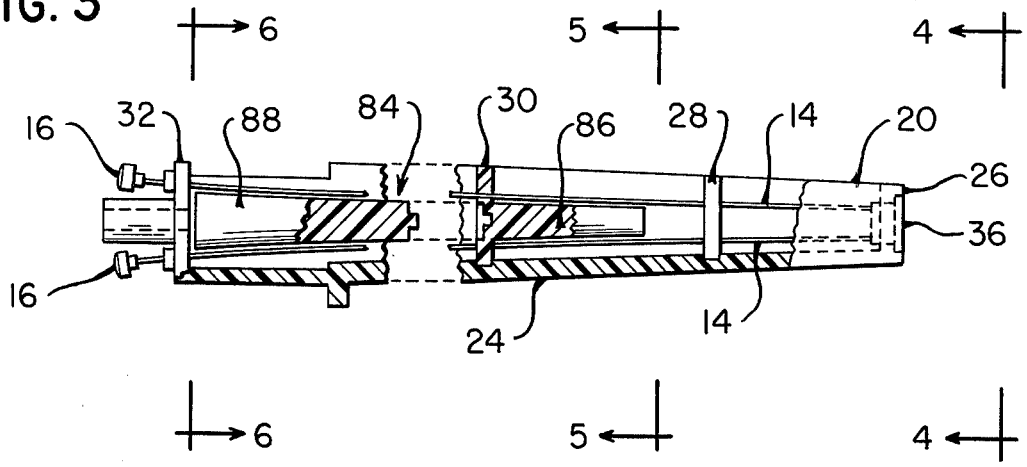
FIG. 3 is an exploded elevation view, partly broken away, showing the frame, the elongated printing elements, and the dampening means, of the embodiment of FIG. 1 of the print head.

A frame 12 is provided to support a plurality of elongated print elements or print wires 14, only two of which are shown, for purposes of simplification and ready understanding of the drawings. Each wire 14 has a cap 16, which may be made of plastic or other suitable material, attached to its impact-receiving end to enlarge the area of the impact-receiving surface. Each wire 14 also has a spring 18 disposed at its upper end, which exerts an upward force upon the cap 16 to resiliently bias the wire upwardly, as shown in FIGS. 1 and 3, relative to the frame 12. The spring 18 has been omitted from one of the wires of FIG. 1, in order that the cap 16 may be more clearly depicted.

Figure 4:
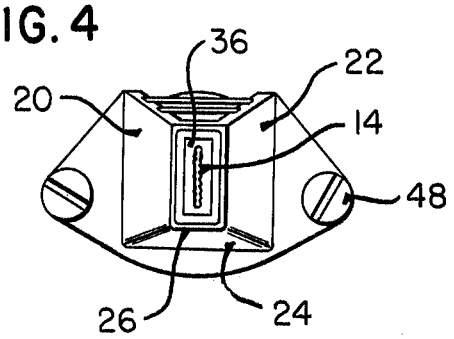
FIG. 4 is an enlarged end view, taken along line 4—4 of FIG. 3.

The frame 12 includes three side walls 20, 22, and 24, a print end support member 26, two intermediate support members 28 and 30 positioned in grooves in the side walls 20 and 22, and an upper end support member 32 which is formed integral with the side walls 20, 22 and 24 of the frame 12. The members 26, 28, 30 and 32 constrain the various print wires 14 in predetermined paths, and accomplish the translation of the wires from a circular formation at the upper end as seen in FIG. 1 to a linear formation at the printing end. The translation is accomplished by passing each wire 14 through a separate hole 34 in the upper member 32, through similar holes in the members 24 and 22, and into a defined position within a bearing 36 in the print end support member 26, as shown in FIG. 4. The bearing 36 is of a material which resists wear and has a low co-efficient of friction.

A pair of mounting flanges 38 and 40 extend laterally from the upper ends of side walls 20 and 22. The frame 12 is circular in cross-sectional shape above the flanges 38, 40 as seen in FIG. 1, and terminates in the upper end support member 32, which is of circular cconfiguration. An apertured post 42 extends from the member 32 and provides means for assembling the driving means for the wires 14 to the frame 12, as will subsequently be described in greater detail.

As shown in FIGS. 1 and 2, a plate 44 is provided with a central aperture 46 and is secured to the flanges 38, 40 on the frame 12 by suitable fastening means 48. The circular portion of the frame 12 extends through the aperture 46. A plurality of holes 50 are provided in the plate 44 for mounting a corresponding plurality, nine in the illustrated embodiment, of actuating means for the wire printing elements 14.

A coil 52, a center pole 54, an "L" shaped outer pole 56 and an armature 58 form the electromagnetic actuating means used in the print head. An armature shim 59 spaces the armatures 58 away from the poles 54 for the purpose of effecting faster armature release.

A unitary connector 62 is mounted by means of a screw 64 and a washer 66 to the post 42 of the frame 12. The connector 62 has a circular central portion 68 with an annular groove 70 provided in its bottom surface. An O-ring 72 is inserted in the groove 70 to act as a shock absorber and to provide a reference surface for the cap 16 of the print wire 14 striking the end of the armature 58. Nine arms 74 are formed integral with the central portion 68 of the connector 62 and extend therefrom. Each arm 74 has associated with it a first armature receiving structure 76 and a second armature receiving structure 78. One end of each armature 58 is received and held in place by the structure 76 and the other end of each armature is received and guided by the structure 78. With the connector 62 installed in the position shown, the arms 74 apply forces to the cantilevered distal ends of the armatures, causing their print wire impacting ends to rotate about the fulcrum formed by the top edge of the pole 56 and upwardly into engagement with the O-ring 72. The caps 16 associated with the print wires 14 are maintained in contact with the ends of the armature 58 by means of the forces applied by the springs 18.

As discussed in greater detail in the previously-cited U.S. Pat. No. 3,929,214, the unitary connector 62 serves a number of functions in the assembly and operation of the print head 10, including retaining the armatures 58 in proper relationship to the remainder of the structure, acting as a biasing means for the armatures, providing means for adjusting the air gap between the armatures 58 and corresponding center poles 52, forming a reference surface for the armatures 58 and print wire caps 16, to assure that all actuated print wires 14 impact the record medium at substantially the same time during a printing cycle, and, by means of the O-ring 72, absorbing energy from the armatures 58 and the print wires 14 on return motion after actuation.

As is also described in greater detail in the previously mentioned U.S. Pat. No. 3,929,214, characters such as numbers, letters or symbols are generated by the print head by a sequence of print cycles. Selective actuation of predetermined combinations of print wires 14 through energization of their corresponding coils 52 during each cycle results in the formation of the desired character on the record medium, with the print head being shifted one position with respect to the record medium after each cycle to be properly located for the next printing cycle.

When a coil 52 is energized, a magnetic flux is created which causes armature 58 to be drawn into contact with center pole 54. The movement of armature 58 transmits energy into print wire 14, causing it to move in an axial direction in the frame 12. The force imparted into the wire 14 causes it to move against the spring 18 and its inertia causes it to continue to move downwardly with the armature 58. The impact-delivering end of the print wire 14 extends beyond bearing 36 and strikes the record medium, causing a dot to be imprinted. The energy stored in the moving print wire 14 and armature 58 is partially absorbed by the impacted record medium and partially returned to the print wire 14, aiding the spring 18 in returning the print wire 14 to its rest position.

At approximately the same time that the print wire 14 is impacting the record medium, the coil 52 is deenergized. The moment exerted on the armature 58 by the arm 74 causes it to rotate away from the center pole 54 and to return into contact with the O-ring 72.

The structure which has been described to this point is conventional and provides an operable print head of the wire matrix type. However extended use of print heads of this type has resulted in problems of breakage of print wires 14 and springs 18 by fatigue failure.

The print wires 14 are small in diameter in order to produce proper character line width, a typical diameter being 0.014 inches. Print wire length is relatively long (typically 3 inches), in order to enable the print wires to be fanned out from their tight linear pattern at the bearing 36 to the larger circular pattern required to coact with the armatures 58. Due to the large ratio of wire length to wire diameter, and the fact that a relatively large impact force (approximately 4.5 pounds) is required to print, the wire 14 has a tendency to buckle. This tendency can be reduced by the addition of transverse supporting members along the length of the wire. As has been previously noted, some matrix print heads also employ anchored tubes or coil springs as supports, in order to further reduce the likelihood of buckling of the print wire.

In the present structure, a series of simple supports 28, 30 and 32 are spaced at intervals along the wire. However wire buckling still tends to take place between the supports. It is believed that a major cause of fatigue failure of print wires is radial oscillation of the wire caused by buckling under printing impact. After the initial buckling takes place, the frequency of the oscillation is dependent upon the natural frequency of the wire between the supports. The amplitude of this oscillation is, from time to time, increased by constructive interference of the wave motion supplied by subsequent impacts. When this occurs, the stress in the wire exceeds the endurance limit of the material.

The present invention reduces wire radial motion by adding a centrally disposed dampening means or internal mode changer 84.

As shown in FIGS. 1 to 6 inclusive, in one embodiment of the invention, the internal mode changer 84 is formed in two portions 86 and 88. The portion 86 is formed integrally with the intermediate support member 30, while the portion 88 is a separate element which is joined to the combination of the portion 86 and support member 30 by any suitable means, such as a snap fit. The effect is to provide a centrally disposed mode changer 84 which is positioned within the array of print wires 14, and which is connected to the frame 12 only by the support member 30. The mounting of the mode changer 84, which is relatively long with respect to its cross-sectional dimensions, to the frame at a location which is intermediate of the ends of the mode changer contributes to its stability and minimizes any tendency toward vibration of the smaller end portion thereof in response to action of the wires thereon.

Figure 6:
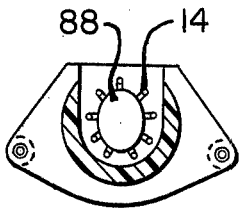
FIG. 6 is a cross-sectional view, taken along line 6—6 of FIG. 3.
Figure 5:
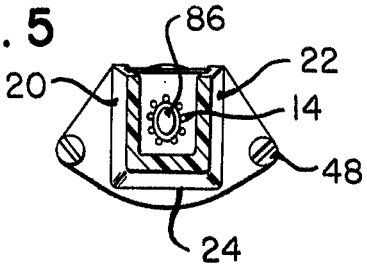
FIG. 5 is a cross-sectional view, taken along line 5—5 of FIG. 3.

It will be noted that the surface of the mode changer 84 is of the same general contour as a surface which includes the array of print wires 14, and that each individual print wire 14 is spaced substantially the same distance as the remaining wires from the surface of the mode changer 84. It will further be noted that the cross section of the mode changer 84 varies from a larger oval configuration at the end closest to the support member 32, as shown in FIG. 5, to a smaller oval shape at the end which is closest to the support member 28, as shown in FIG. 6. This corresponds to the wire array which is arranged in an oval configuration near the support member 32, in conformity to the circular arrangement of the coils 52, and which is guided by the support members 32, 30, 28 and 26 to a linear alignment at the printing end of the print head, as shown in FIG. 4.

Figure 7:
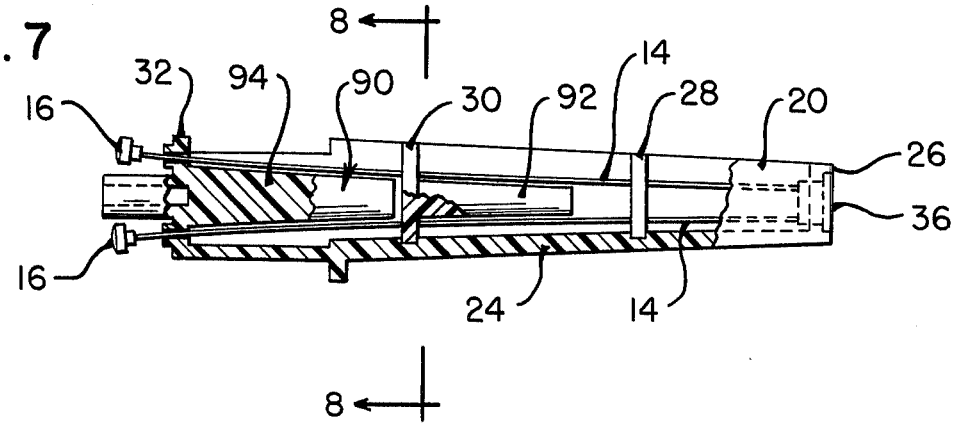
FIG. 7 is an elevation view, partly broken away, showing the frame, the elongated printing elements, and the dampening means, of a second embodiment of the invention.
Figure 8:
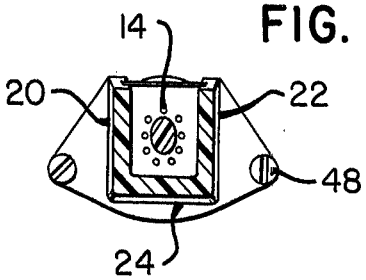
FIG. 8 is a cross-sectional view, taken along line 8—8 of FIG. 7.

A second embodiment of the invention is shown in FIGS. 7 and 8. This embodiment is quite similar to the embodiment of FIGS. 1 to 6 inclusive, except that an internal mode changer 90, while of the same general configuration, is connected to the frame 12 in a different manner. A first portion 92 of the mode changer 90 is formed integral with the support member 30 in the same manner as in the first embodiment. However a second portion 94, instead of being attached to the combined support member 30 and first portion 92, is formed integral with the support member 32. Here again the design avoids stability problems which might be found if the relatively long mode changer 90 were fixed to the frame only at its large end. Other means of securing portions of the mode changer to one or more support members of the frame in accordance with the above teaching will suggest themselves to those skilled in the art.

The purpose of the mode changer, in either embodiment, is two-fold. First, by its close proximity to the printing wires 14, it prevents an excessive radial excursion of the wires during printing movement, due to initial buckling, and second, by this same restraint it prevents the printing wires 14 from oscillating at their natural frequency. It will be noted that the internal mode changer 84 or 90 is held stationary inside the array of print wires 14, so that the wires do not contact the mode changer until after they buckle. Therefore no frictional drag or extra mass is added to the print wires on their flight toward the impacct surface.

While the forms of the invention shown and described herein are admirably adapted to fulfill the objects primarily stated, it is to be understood that it is not intended to confine the invention to the forms or embodiments disclosed herein, for it is susceptible of embodiment in various other forms within the scope of the appended claims.

What is claimed is:

1. A printing mechanism comprising:

frame means including at least one transverse support member located in a position spaced from each of the ends of the frame means;

a plurality of elongated printing elements extending through and supported by said support member in an array of generally conical configuration and capable of being driven in an axial direction to effect printing;

driving means operatively connected to said printing elements for axially driving said printing elements; and dampening means of generally conical configuration disposed completely within said array of elongated printing elements, secured to said support member and having a surface from which each of the elongated printing elements is physically separated when at rest and when in normal axial movement, said dampening means being positioned to limit undesired transverse movement and vibration of said elongated printing elements during and following operation thereof by said driving means.

2. The printing mechanism of claim 1 in which the dampening means comprises two portions and in which a first portion of the dampening means is secured to one side of said transverse support member and in which a second portion of the dampening means is secured to the other side of said support member.

3. The printing mechanism of claim 1, also including a second transverse support member in said frame means, and in which a first portion of the dampening means is integral with the first-mentioned support member and a second portion of the dampening means is integral with said second transverse support member.

4. The printing mechanism of claim 1, also including a second transverse support member in said frame means, and in which a first portion of the dampening means is secured to the first-mentioned support member and a second portion of the dampening means is secured to said second transverse support member.

5. The printing mechanism of claim 1 in which the surface of the dampening means which coacts with the elongated printing elements is substantially smooth and unslotted.

6. The printing mechanism of claim 1 in which the dampening means limits the transverse movement of the elongated printing elements in an inward direction with respect to the frame means.

7. The printing mechanism of claim 1 in which the cross-sectional configuration of the dampening means is of a generally oval shape.

8. A printing mechanism comprising:

elongated frame means including a plurality of transverse support members;

a plurality of elongated printing elements extending through and supported by said support members in an array of generally conical configuration and capable of being driven in an axial direction to effect printing;

driving means operatively connected to said printing elements for axially driving said elements; and dampening means of generally conical configuration, centrally disposed and secured within the frame means completely within the array of printing elements and having a generally smooth unslotted surface between support members from which surface each of the elongated printing elements is spaced approximately equidistantly at rest and in axial movement, undesired transverse movement and vibration of said elongated printing elements in an inward direction during and following operation thereof by said driving means being limited by contact with the surface of said dampening means.

9. The printing mechanism of claim 8 in which the dampening means is secured to one of said support members which is spaced from each of the ends of the frame means.

10. The printing mechanism of claim 9 in which the dampening means comprises two portions and in which a first portion of the dampening means is integral with said one of said support members at one side thereof and extends in one direction and a second portion of the dampening means is secured to the other side of said one of said support members and extends in an opposite direction from said first portion and in alignment therewith.

11. The printing mechanism of claim 8 in which a first portion of the dampening means is secured to a first support member and a second portion of the dampening means is secured to a second support member.

12. The printing mechanism of claim 8 in which a first portion of the dampening means is integral with a first support member and a second portion of the dampening means is integral with a second support member.

13. The printing mechanism of claim 11 in which the first and second portions of the dampening means are aligned with each other and have unattached ends which extend in the same direction.

* * * * *